US005938488A

United States Patent [19]

Wilmes

[11] Patent Number: 5,938,488

[45] Date of Patent: Aug. 17, 1999

[54] CLAMPING DEVICE FOR ELECTRICAL CONDUCTORS

[75] Inventor: Manfred Wilmes, Detmold, Germany

[73] Assignee: Weidmuller Interface GmbH & Co., Germany

[21] Appl. No.: 08/921,031

[22] Filed: Aug. 29, 1997

[30] Foreign Application Priority Data

Aug. 30, 1996 [DE] Germany ..... 196 35 135

[51] Int. Cl.[6] ..... H01R 4/50

[52] U.S. Cl. ..... 439/864

[58] Field of Search ..... 439/864, 807, 439/815

[56] References Cited

U.S. PATENT DOCUMENTS 3,873,178 3/1975 Galli ..... 439/864

FOREIGN PATENT DOCUMENTS 237644 6/1960 Australia ..... 439/864
248851 3/1963 Australia ..... 439/864
0 271 594 B1 12/1986 European Pat. Off. .

*Primary Examiner*—Paula Bradley
*Assistant Examiner*—Tho D. Ta
*Attorney, Agent, or Firm*—Laubscher & Laubscher

[57] ABSTRACT

A clamping device for electrical conductors is characterized by a housing and a clamping member rotatably connected with the housing via an improved bearing assembly. The bearing assembly includes an embossed journal on one side of the clamping member and an embossed bore in the other side of the clamping member. The journal fits within an opening in one side wall of the housing and a tongue having a circular portion bent inwardly from the other side of the housing fits within the bore of the clamping member. When the clamping member is activated, it rotates within the housing to clamp an electrical conductor against a bus bar segment.

5 Claims, 2 Drawing Sheets

CLAMPING DEVICE FOR ELECTRICAL CONDUCTORS

BACKGROUND OF THE INVENTION

The present invention relates to a device for clamping electrical conductors such as wires and the like to other electrical components such as a bus bar. The device affords mechanical clamping of a conductor to prevent the conductor from being displaced and thus to assist in retaining an electrical connection with the bus bar.

BRIEF DESCRIPTION OF THE PRIOR ART

Clamping devices for wires and other electrical conductors are known in the art as evidenced by European Patent No. 271,594. As disclosed therein, a housing has a clamping member arranged therein. The clamping member has two bearing journals that are molded or forged in a forging die that afford pivotal movement of the clamping member with respect to the housing when a clamping screw is activated.

While such a device operates satisfactorily, the machinery and labor required to manufacture the molded journals of the clamping member is high, resulting in excessive costs. Similarly, the machinery required to form the corresponding journal bores in the housing is also expensive, further increasing the cost.

SUMMARY OF THE INVENTION

Accordingly, it is a primary object of the present invention to provide an improved clamping device for an electrical conductor including an embossed journal and bore assembly for connecting the clamping member with the housing. More particularly, the device includes a hollow housing having a pair of side walls and containing a first opening for receiving an electrical conductor and a second threaded opening for receiving a clamping screw. A clamping member is arranged in the housing for clamping the conductor against a bus bar arranged in the housing. A bearing assembly rotatably connects the clamping member with the housing. The bearing assembly includes an embossed journal extending from one side of the clamping member and an embossed bore in the other side. One of the housing side walls contains an opening for receiving the journal and the other side wall contains a tongue which is bent inwardly to engage the embossed bore.

According to a more specific object of the invention, the tongue has an outer contour configured as a circular arc. The outer diameter of the tongue preferably corresponds with the inner diameter of the embossed bore. Similarly, the outer diameter of the journal corresponds with the inner diameter of the side wall opening.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
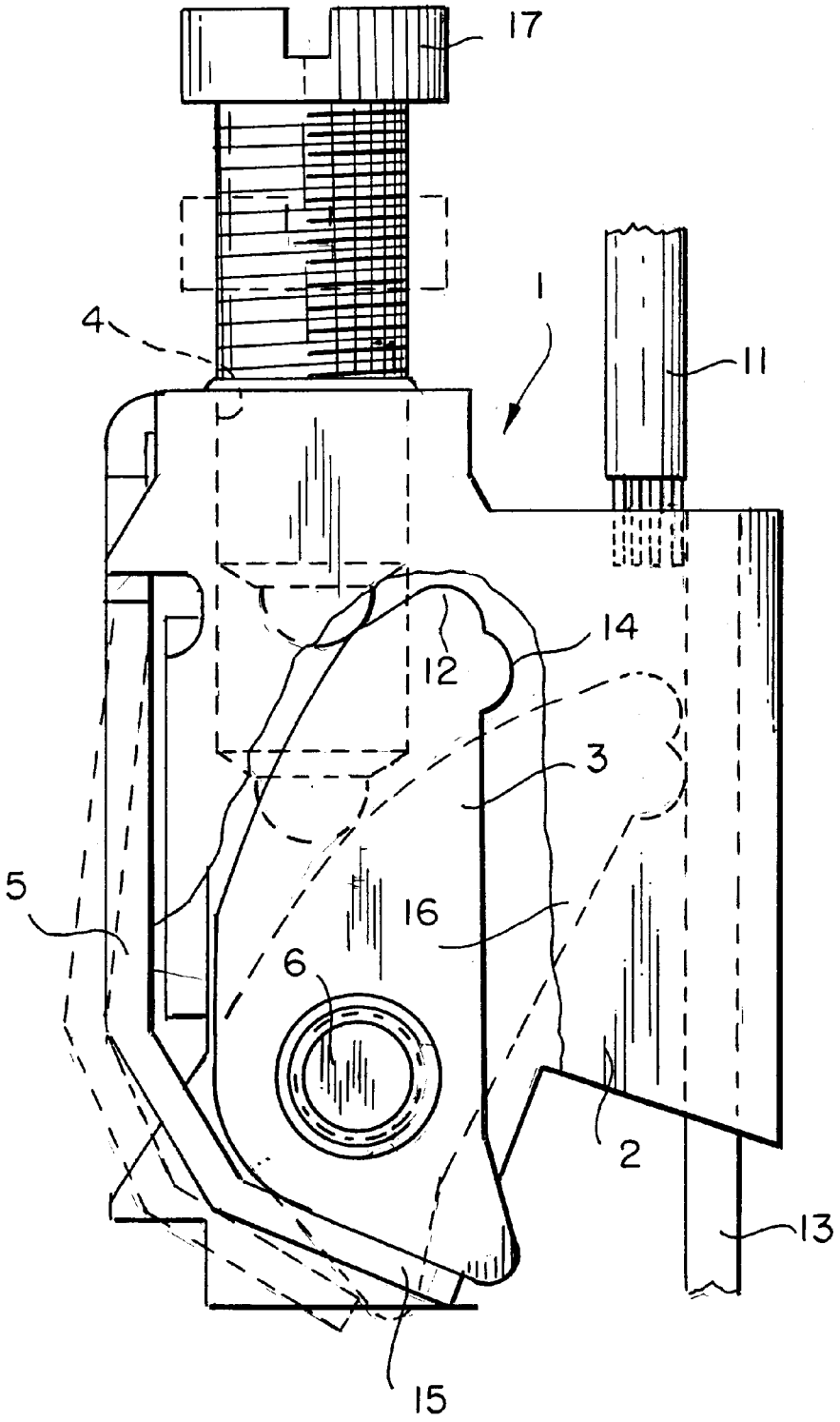
FIG. 1 is a cutaway side view of the improved clamping device according to the invention.

Referring first to FIG. 1, the clamping device for electrical conductors according to the invention will be described. The clamping device includes a hollow housing 1 including opposed pairs of side walls 2 and in which a clamping member 3 is arranged. The housing is preferably formed of sheet metal using a die stamping process. It includes a threaded opening 4 for receiving a clamping screw 17 which activates the clamping member as will be developed below.

The housing also contains a bus bar segment 13 and a chamber for receiving an electrical conductor 11. The clamping device according to the invention is used to clamp the conductor 11 against the bus bar segment 13. More particularly, the clamping member 3 is in the form of a longitudinal lever pivotally connected with the housing 1. When the clamping screw is rotated, the lower portion thereof engages a portion 12 of the clamping member, causing the member to pivot in the direction of the conductor 11 and bus bar segment 13. Further rotation of the screw pivots the clamping member 3 so that a clamping portion 14 of the member engages and clamps the conductor against the bus bar segment as shown by the dashed lines in FIG. 1.

A spring 5 is provided on the housing 1. The lower end 15 of the spring is bent and abuts against the lower portion 16 of the clamping member 3. The spring serves to bias the clamping member toward its open unclamping position shown by the solid lines in FIG. 1. The spring is preferably molded directly on the housing, although it could also be formed as an integral part of the housing. It extends toward the clamping member 3 from the exterior of the housing. Preferably, the spring 5 extends from its upper area generally parallel to the longitudinal clamping member and engages the lower portion of the clamping member via the bent lower end 15. The clamping portion 14 of the member is arranged on the opposite side of the member relative to the spring 5 and the clamping screw 17. As the clamping member pivots toward the clamping position shown by the dashed lines in FIG. 1, the spring is displaced outwardly from the housing by the clamping member. The deflection of the spring provides sufficient force to pivot the clamping member back to its unclamping position when the clamping screw is released.

Figure 2:
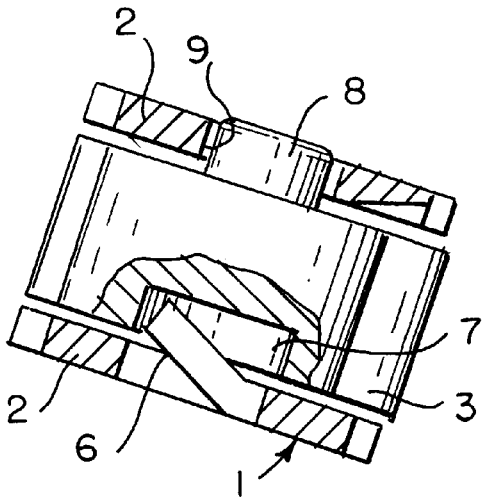
FIG. 2 is a partial, sectional top view of the device of FIG. 1 showing the connection between the clamping member and the housing.
Figure 3:
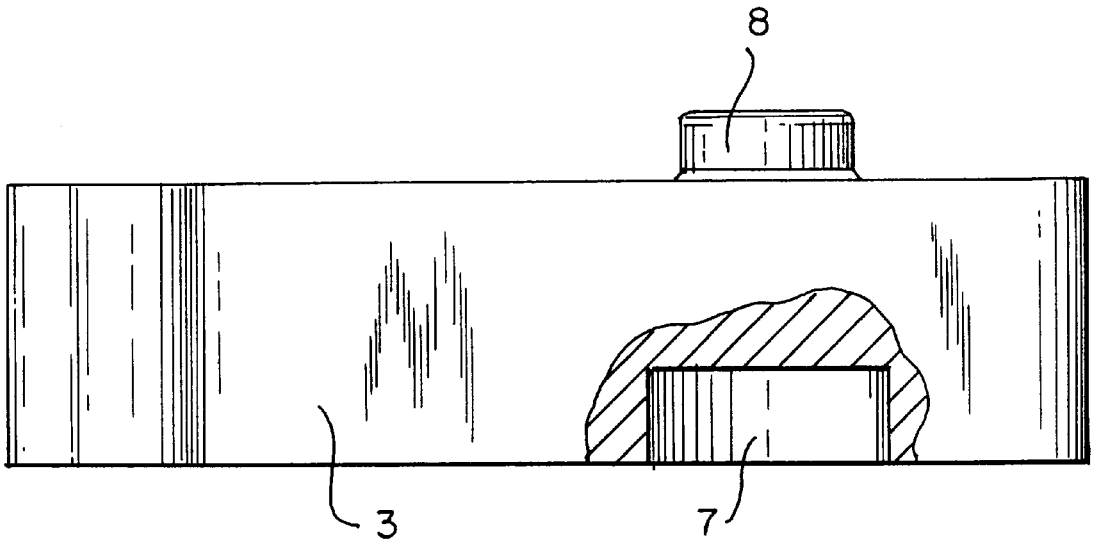
FIG. 3 is a partial cutaway top view of the clamping member.

In order to pivotally or rotatably connect the clamping member 3 with the housing 1, a bearing assembly is provided. As shown in FIGS. 2 and 3, the bearing assembly includes an embossed journal 8 extending from one side of the clamping member 3 and an embossed eyelet or bore 7 in the other side of the member. Preferably, the journal 8 and bore 7 of the clamping member are embossed in a single step.

One housing side wall 2 contains an opening 9 for receiving the clamping member journal 8 as shown in FIG. 2. Preferably, the outer diameter of the journal corresponds with the inner diameter of the opening to afford smooth rotation of the journal within the opening. The other housing side wall contains a tongue 6 which is bent or crimped inwardly to engage the bore 7 in the clamping member. As shown in FIG. 1, the tongue has an outer contour in the shape of a circle. The crimped area of the tongue 6 engages the clamping member bore 7 similar to a bearing pin. The outer diameter of the tongue crimped portion corresponds with the inner diameter of the bore to afford unhindered rotation of the clamping member 3, particularly since the rotational movement of the member extends only over a relatively small angular area.

While in accordance with the provisions of the patent statue the preferred forms and embodiments of the invention have been illustrated and described, it will be apparent to those of ordinary skill in the art that various changes and modifications may be made without deviating from the inventive concepts set forth above.

What is claimed is:

1. Apparatus for clamping an electrical conductor, comprising:

(a) a hollow housing including side walls and containing a first opening for receiving an electrical conductor and a second threaded opening for receiving a clamping screw;

(b) a clamping member arranged within said housing for clamping the conductor relative to a bus bar within said housing; and (c) bearing means for rotatably connecting said clamping member with said housing, said bearing means including an embossed journal extending from one side of said clamping member and an embossed bore formed in said clamping member in a side opposite said one side.

2. Apparatus as defined in claim 1, wherein one of said housing side walls includes a tongue which is bent inwardly to engage said embossed bore, said tongue having an outer contour configured as a circular arc.

3. Apparatus as defined in claim 2, wherein said tongue is pressed into said embossed bore after said clamping member is inserted in said housing.

4. Apparatus as defined in claim 2, wherein the other of said housing side walls contains an opening for receiving said embossed journal.

5. Apparatus as defined in claim 4, wherein the inner diameters of said side wall opening and embossed bore correspond with the outer diameters of said embossed journal and tongue, respectively.

* * * * *